US005331904A

United States Patent [19]

DiSimone et al.

[11] Patent Number: 5,331,904

[45] Date of Patent: Jul. 26, 1994

[54] MECHANIC'S TOOL TRAYS AND SUPPORT ASSEMBLY

[75] Inventors: Robert P. DiSimone, 1263 Shadow Oak Dr., Malvern, Pa. 19355; Leonard R. Clark, Jr., Oreland, Pa.

[73] Assignee: Robert P. DiSimone, Malvern, Pa.

[21] Appl. No.: 800,007

[22] Filed: Nov. 29, 1991

[51] Int. Cl.[5] ..... A47B 37/00

[52] U.S. Cl. ..... 108/44; 211/175; 108/143; 108/26

[58] Field of Search ..... 108/42, 44, 8, 25, 152, 108/26, 157, 143; 224/42.44; 211/175, 201; 312/205

[56] References Cited

U.S. PATENT DOCUMENTS 4,811,875 3/1989 DiSimone ..... 108/44

*Primary Examiner*—Kenneth J. Dorner
*Assistant Examiner*—Gerald A. Anderson
*Attorney, Agent, or Firm*—Lackenbach Siegel et al.

[57] ABSTRACT

An improved tool tray support assembly comprises a center section, opposed extensible lateral support members and end support assemblies. The end support assemblies fit onto end sections of the lateral support members, and support the assembly on opposed edges of an engine compartment of a motor vehicle. The lateral support members slide within the center section and can be locked at any desired position to adjust the spacing of the end supports to accommodate various engine compartments. The angular orientation of the center section can be varied by adjustment of the position of the lateral support members with respect to the end supports. Tool trays of standard dimensions fit between the opposed lateral rails of the support member to enable convenient storage of small tools and parts. The tool tray assembly may also be supported beneath a vehicle service lift or the like, and the tool trays may be supported by brackets on wheeled stools for increased flexibility in their use.

48 Claims, 3 Drawing Sheets

MECHANIC'S TOOL TRAYS AND SUPPORT ASSEMBLY

BACKGROUND OF THE INVENTION

1. Field of the Invention

This invention relates to tool trays for mechanics and a tool tray support assembly adapted to fit between and be supported by the opposed edges of an engine compartment of a motor vehicle or the like.

2. Description of the Prior Art

DiSimone U.S. Pat. No. 4,811,875, issued to one of the present inventors on Mar. 14, 1989, discloses a portable automotive bench comprising a center section and two opposed drawers slidably received within the center section. Support members mounted on the opposed lateral ends of the two drawers rest on opposed lateral edges of an engine compartment of a motor vehicle or the like. The center section is movable from side to side to allow access to the drawers. The present invention represents an improvement on the portable automotive bench disclosed in the DiSimone patent.

OBJECTS AND SUMMARY OF THE INVENTION

In is an object of the present invention to improve upon the automotive bench disclosed in DiSimone U.S. Pat. No. 4,811,875 while achieving all of the useful objects and advantages of that invention.

More particularly, it is an object of the present invention to provide a mechanic's tool tray and support assembly manufacturable less expensively and providing additional flexibility in use with respect to that disclosed in DiSimone U.S. Pat. No. 4,811,875.

More specifically, it is an object of the present invention to provide a mechanic's tool tray and support assembly which can be disassembled into its component parts very readily, for storage under lock and key in an conventional mechanic's tool box having storage compartments of standard sizes, to prevent theft of the tool tray of the invention.

It is a further object of the invention to provide tool trays for being supported by a support assembly resting on opposed edges of an engine compartment of a motor vehicle or the like, the trays also fitting within storage compartments of standard sizes of a standard mechanic's tool chest, so that a mechanic can store the tools, parts, and supplies used to perform certain standard tasks in one or more of the trays, and simply take those trays containing the tools, parts, and supplies needed for performance of any specific task from his tool chest and place those trays on the tool tray support assembly of the invention in preparation for that task.

It is a further object of the invention to provide a tool tray support assembly as described above and also comprising a work shelf and a work light, to provide a convenient flat surface for the mechanic to store parts and tools and to provide illumination to render his work more convenient.

It is a further object of the invention to provide a tool tray support structure adapted to hang from a standard vehicle service lift to enable the mechanic to conveniently use the tool trays and support assembly of the invention when working beneath a vehicle.

It is a further object of the invention to provide a tool tray support assembly whereby individual tool trays can be readily supported by a roll-around stool, so that a mechanic may obtain maximum versatility in use of tool trays purchased for use with the tool tray support assembly of the present invention.

These and other aspects, objects and advantages of the present invention will be apparent to those of skill in the art as the discussion of the invention below proceeds.

The objects of the invention mentioned above are satisfied by the tool trays and support assembly of the present invention. The support assembly comprises a center member including a work shelf, two laterally extensible support members each comprising two parallel rails slidably received by the center member, and two end support assemblies attachable to laterally opposed distal ends of the laterally extensible support members. The support members slide within channels in the center member so as to be adjustable to suit the width of the engine compartments of various motor vehicles. The center member comprises locking levers to secure the extensible support members at desired positions. The end support members allow adjustment of the angle formed between foot members resting upon the opposed lateral edges of the engine compartment with respect to the support members and center member, so that the tool tray of the invention is useful with vehicles wherein the edges of the engine compartment are not horizontal.

In order to render the tool tray support assembly of the invention convenient in use, and so that all components fit conveniently within the drawers of a normal mechanic's tool chest, the end support assemblies are made readily removable from the ends of the laterally extensible support members. All components of the end support assemblies remain attached to one another when removed from the support members, so that the mechanic is not obliged to search for small parts in order to assemble the tool tray of the invention.

The end support assemblies each comprise a keying member comprising a slot on one side receiving the end portions of the laterally extendable support members, and radial keys on the other side thereof. The radial keys on the keying members are drawn axially into engagement with mating radial keys formed on end supports also comprising the feet resting on the edges of the engine compartment. Hand screws are provided for axially engaging the end supports, the lateral support members and the keying members.

The tool trays comprise generally rectangular box members having overhanging portions extending along their longitudinal edges. The overhanging portions rest on the opposed parallel rails of the lateral support members, while a central box portion fits between the rails of the support members. The dimensions of the trays are such that they fit within the standard drawers of standard mechanic's tool chests. In this way a mechanic who customarily performs the same set of tasks repetitively can collect whatever tools and parts commonly are required for each particular task in one or more of the standard tool trays and select those trays from his tool box when that task is required to be performed once again. This provides very convenient tool organization. The tool trays may comprise or be fitted with tool organizers to conveniently retain particular sets of tools, such as socket sets. The same tool trays may also be supported beneath a roll-around stool for convenient working in confined spaces.

Hanging end supports may also be provided for supporting the tool tray support assembly beneath a vehicle service lift or the like. The hanging end supports interfit with the ends of the lateral support members in essentially the same manner as the end support assemblies provided to rest on opposed lateral edges of an engine compartment of a motor vehicle.

The invention will be better understood if reference is made to the accompanying drawings.

DESCRIPTION OF THE PREFERRED EMBODIMENTS

Figures 1, 2, 9:
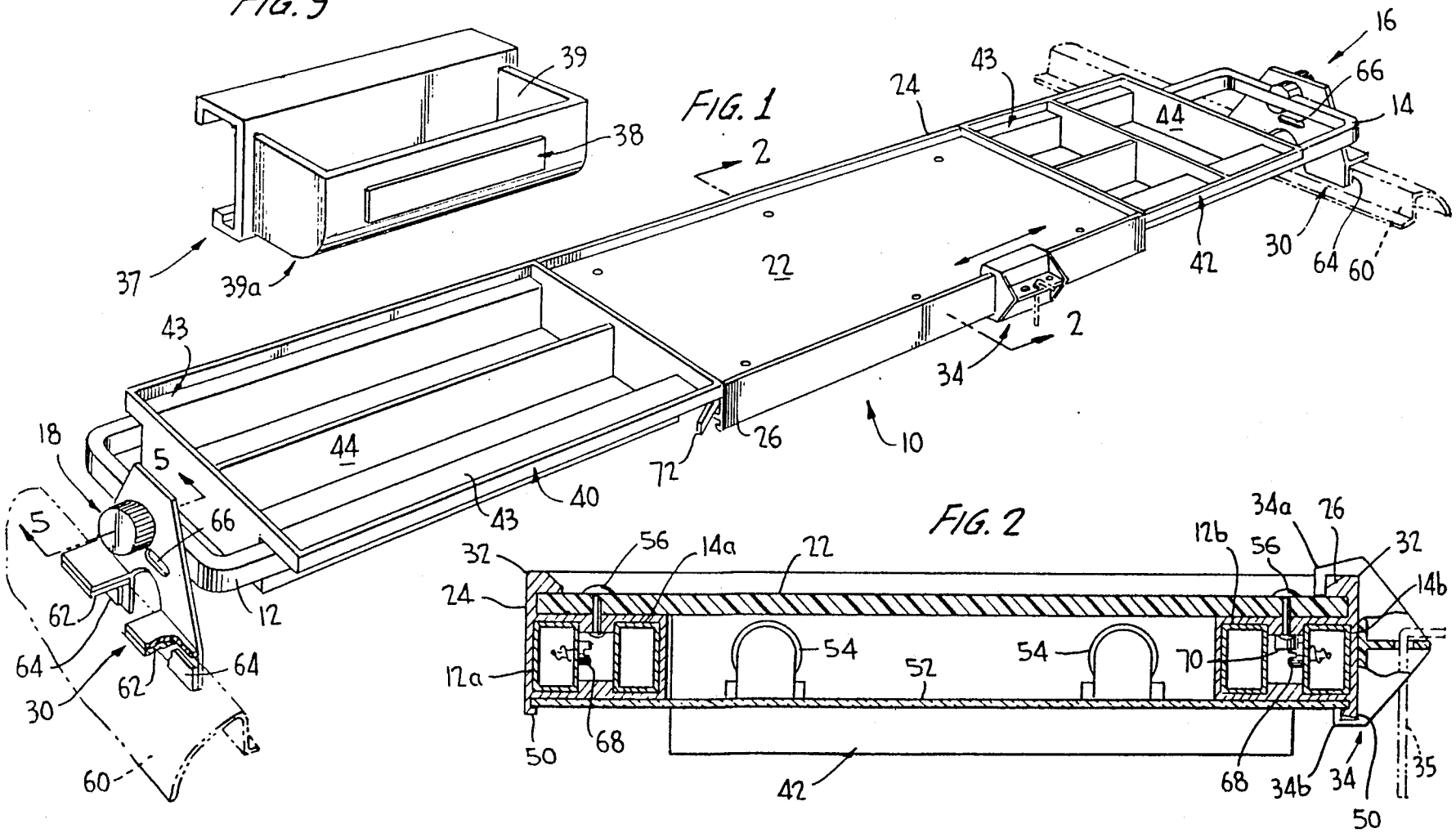
FIG. 1 is a perspective view of the tool tray support assembly of the invention, together with several tool trays and an exemplary accessory block.
FIG. 2 is a cross-section taken along the line 2—2 of FIG. 1.
FIG. 9 is a perspective view of a accessory tool box adapted to be supported on the center member of the tool tray support assembly of the present invention.
Figure 3:
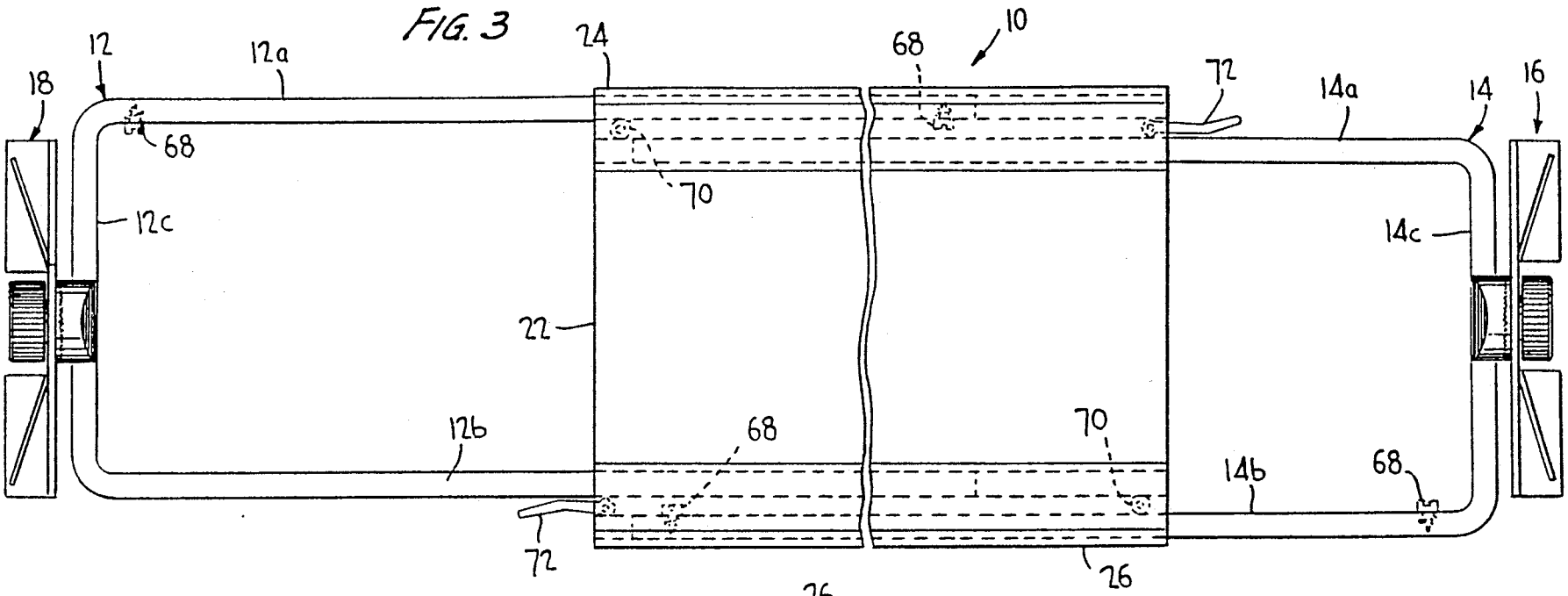
FIG. 3 is a plan view of the tool tray support assembly of the present invention.

Referring now to FIGS. 1, 2 and 3, the tool tray support assembly of the invention comprises a center member 10, two identical opposite laterally extensible support members 12 and 14, and two identical end support assemblies 16 and 18. The center support member 10 comprises a work surface 22, essentially a plain rectangular panel of a durable plastic material, and two identical sections 24 and 26 of a continuous aluminum extrusion. As shown in FIG. 2, the sections 24 and 26 of the aluminum extrusion each comprise two longitudinally extending channels for receiving parallel rails 12*a* and 12*b* of the first lateral support member 12 and parallel rails 14*a* and 14*b* of the second lateral support member 14. The lateral support members 12 and 14 are formed by bending lengths of stock material of continuous cross-section, e.g. plated rectangular section steel tubing, into U-shapes. Thus, for example, support member 12 comprises parallel rails 12*a* and 12*b* and end section 12*c*. As indicated, the rails are received by the sections 24 and 26 of the extrusion in interdigitated fashion; that is, the four rails 12*a*, 12*b*, 14*a* and 14*b* all lie in a plane parallel to the work surface 22, and the parallel rails of each of the lateral support members are spaced equally from one another. In this way, the lateral support members are identical, simplifying manufacturing and reducing cost. Alternatively, the rails could telescope within one another, or the rails of one support member could be disposed beneath the other; either alternative would be more costly.

In order that the center of gravity of the overall assembly is centered, the end supports 16 and 18 are attached to the lateral support members 12 and 14 off center with respect to the rails of the respective support members. Thus, as seen in FIG. 3, lateral support member 12 is displaced to one side of the center member while lateral support member 14 is displaced to the other side; however, the end supports 16 and 18 lie on the center line of overall assembly. In this way the overall assembly is well balanced and stable in use. Either end support may be assembled to either support member, simplifying assembly of the tool tray support assembly prior to use.

As further shown in FIG. 2, the extrusion from which sections 24 and 26 are taken also comprises a C-shaped upper member 32 defining a channel receiving the lateral edges of the work shelf 22. An accessory block 34 is formed to comprise a hook 34*a* fitting over the C-shaped member 32 of the extrusion, to support the block 34 thereon. The accessory block 34 may include a second hook 34*b* fitting over a tab 50 formed on the lower surface of the extrusion. The accessory block 34 may comprise a small shelf having holes therein for receiving small tools or the like as indicated in phantom at 35 in FIG. 2. A different version 37 of the accessory block shown in FIG. 9 may include a small open parts box 39. Desirably the corner at which the bottom of the parts box 39 meets its front surface is curved as indicated at 39*a*; this makes it easy for the mechanic to reach into the box 39 and scoop small parts out. A magnet 38 may be attached to the front of the box 39 for convenience in storing small ferrous tools.

Returning to the discussion of FIG. 1, first and second tool trays 40 and 42 are shown. Tool trays 40 and 42 each are formed so that their ends are generally of T-configuration, that is, so that trays 40 and 42 comprise overhanging opposed lateral portions 43 resting on the rails 12*a* and 12*b*, and depressed center portions 44 resting between the rails 12*a* and 12*b*. In a preferred embodiment these tool trays 40 and 42 are molded integrally of a durable plastic material, and are sized such that they fit efficiently within the standard drawers of a standard mechanic's tool box. Typically this will require that their depth be no more than two inches. These tool trays may be made in a number of different lengths and may have various internal dividers for convenient storage of various collections of tools, parts and the like. The tool trays may comprise or be fitted with tool organizers for conveniently receiving and retaining various sets of tools such as socket sets, sets of screwdrivers, and the like.

Referring now to FIG. 2, it will also be observed that the extrusion from which sections 24 and 26 are taken comprises a lower tab portion 50 on its under surface for receiving a clear plastic window 52. Within the space created between the work surface 22 and the window 52 may be mounted one or more fluorescent lamps 54 or other source of illumination; these may be mounted on the window 52 as shown, or mounted to the underside of the work surface, as convenient. The window 52 protects the lamps 54 from damage in use and in storage.

It will also be apparent from FIG. 2 that the work shelf 22 may be permanently joined to the sections 24 and 26 of the extrusion by rivets or screws indicated generally at 56.

As seen in FIG. 1, the end support assemblies 16 and 18 each comprise feet 30 for being received on the opposed lateral edges 60 of an engine compartment of a motor vehicle or the like. Of course, the tool tray support assembly of the invention is also useful for other applications. In order to avoid marring the surface finish of the vehicle, resilient rubber pads 62 may be provided beneath the feet 30. Magnets 64 may also be provided to ensure stable resting of the end supports 16 and 18 on the opposed lateral edges of the engine compartment of the vehicle. Where the vehicle is of nonferrous material a security strap (not shown) having a hook or suction cups at one end may be provided to secure the end support members 16 and 18 to the vehicle. To facilitate this possibility, slots 66 are formed in end supports 16 and 18 to receive a security strap, elastic cord or the like.

Referring now to FIG. 3, stop screws 68 are provided at the lateral ends of one of the rails of each of the two lateral support members 12 and 14. These stop screws 68 are adapted to abut stop members 70 mounted in sections 24 and 26 of the extrusion adjacent the channels in which the rails ride. Thus the stop screws 68 limit the excursion of the support members 12 and 14 with respect to the center section 10, so that the support members 12 and 14 remain assembled to the center section 10, further simplifying the use of the system of the invention. If necessary the stops 70 can be removed to allow removal of the support members 12 and 14 from the center section 10.

Figure 4:
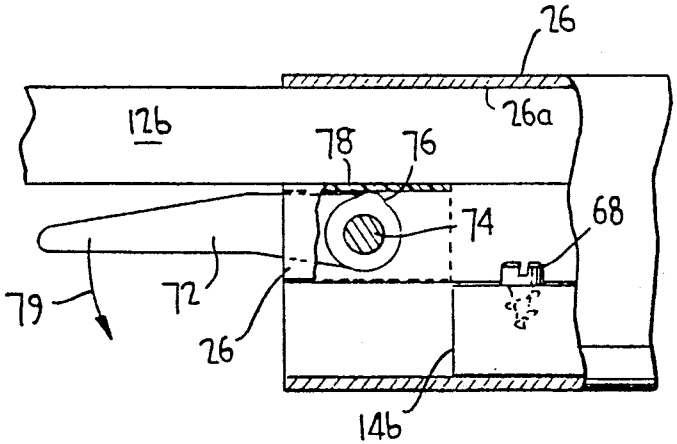
FIG. 4 is an enlarged view showing a locking lever assembly whereby the laterally extensible support members are locked with respect to the center member.

FIG. 4 details the structure of the locking lever assembly provided to enable the mechanic to lock the support member 12 in any desired position with respect to the center member 10. A similar assembly is provided with respect to support member 14, as seen in FIG. 3. The locking lever assembly comprises a lever 72 pivoted on a pivot member 74 fixed in a bore in the respective section 26 of the extrusion. As shown the locking lever 72 comprises a cammed surface 76 to urge the corresponding rail **12*b* into engagement with the inner surface 26*a* of the corresponding section 26 of the extrusion. A generally U-shaped anti-friction member 78, formed of a "slippery" plastic such as molybdenum disulfide filled nylon, may be provided between the cammed surface 76 and the rail 12*b*, so that when the locking lever is disengaged by rotating it counterclockwise (as indicated by the arrow 79 in FIG. 4), the rail 12*b* can slide freely within the channel of the extrusion 26. The pivot member 74 retains anti-friction member 78 in proper relation to the locking lever 72**.

Figure 5:
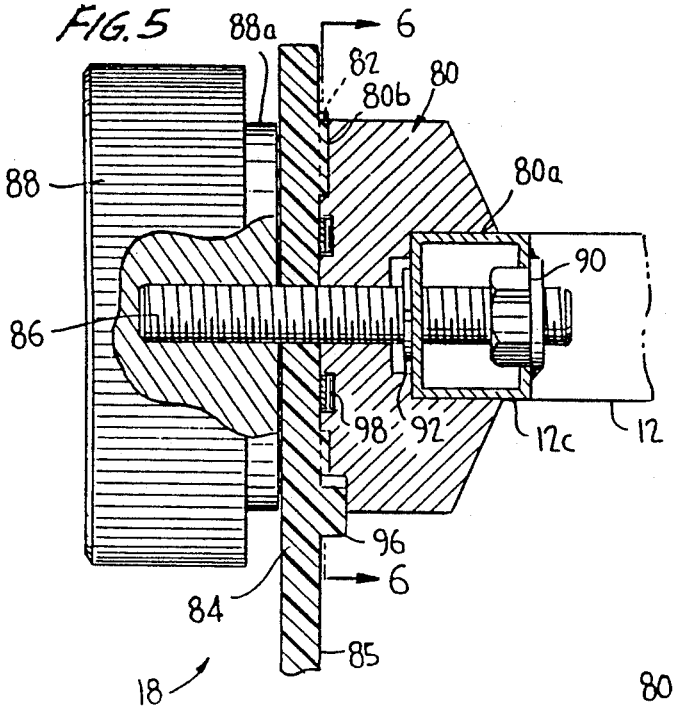
FIG. 5 is a cross-sectional view taken along the line 5—5 of FIG. 1.
Figure 6:
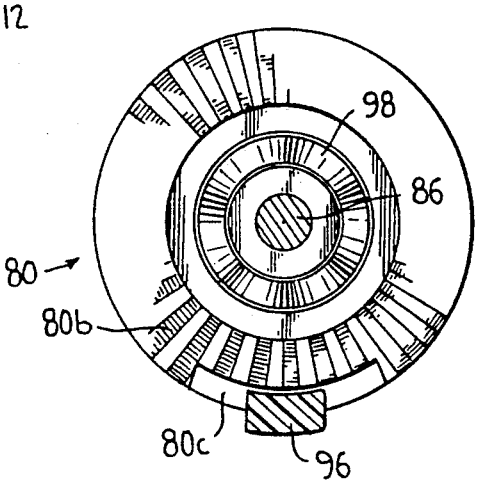
FIG. 6 is a cross-sectional view taken along the line 6—6 of FIG. 5.

FIGS. 5 and 6 provide details of the interconnection of the end support assembly 18 with the respective support member 12. An identical connection is formed between end support assembly 16 and support member 14. As noted, the end supports are interchangeable with respect to the support members. The end support assembly 18 includes a key member 80 formed to include a recess **80*a* for receiving end section 12*c* of the support member 12. Thus the support member 12 is precluded from rotation with respect to the key member 80. The key member 80 also comprises a plurality of radial keys 80*b* molded on the opposite surface thereof. Keys 80*b* interfit with mating radial keys 82 formed on a molded upright 84. Thus when the key member 80 is drawn axially into engagement with the upright 84, the keys 80*b* and 82 engage, preventing relative rotation of the key member 80 with respect to the upright 84. The upright 84 is also molded to include a vertical spacing portion 85 and the foot 30, as shown in FIG. 1. The foot 30 is separated by a few inches from the mounting structure illustrated in FIG. 5 by the spacing portion 85**.

The radial keys **80*b* on key member 80 are drawn into engagement with the keys 82 on the end support 18, and the end section 12*c* of the support member 12 is affixed to the upright 84, by a threaded hand screw 86. One end of hand screw 86 is permanently joined to a knob 88, while the other end of the hand screw 86 is threaded into a captive nut 90 typically spot-welded to the end portion 12*c* of the support member 12. When the mechanic desires to remove the end support 18 assembly from the support member 12 he simply turns the knob 88 counterclockwise, unscrewing the hand screw 86 from the captive nut 90. The key member 80, knob 88, and hand screw 86 are retained on the end support 84 by a spring clip 92 received in a groove in the threaded hand screw 86. In this way the components of the end support assembly 18** do not become separated from one another in the mechanic's tool box and can be readily attached when desired.

The mating radial keys 82 and **80*b* allow the relative orientation of the end support 84 and the support member 12 to be varied over a substantial range of angles. The extent of this range is controlled by the interfitting of a peg 96 formed on the end support 84 within a recess 80*c* formed on the key member 80. Thus the angular extent of the recess 80*c* controls the maximum amount of angular adjustment of the position of the support member 12 possible with respect to the upright 84**.

In order to facilitate angular adjustments, a "wave" spring washer 98 is retained between the mating keys **80*b* and 82. Thus, when the knob 88 is turned counterclockwise to release axial engagement of the teeth, the wave washer 98 positively urges the teeth out of engagement with one another, simplifying angular adjustment of the relevant positions of the support member 12 with respect to the upright 84 of the end support assembly 18**.

In the preferred embodiment, the key member 80 is molded to comprise the radial keys **80*b*, the arcuate recess 80*c* and the recess 80*a* for receiving the end section 12*c* of the support member 12. The upright 84 is similarly molded to comprise the keys 82 and the feet 30 (FIG. 1) as well as peg 96. The knob 88 may be turned of metal or molded of plastic; in either event it preferably comprises a shoulder portion 88*a*, of similar radial extent as the keys 80*b* and 82**, further providing durability and reliability to the structure.

Figure 7:
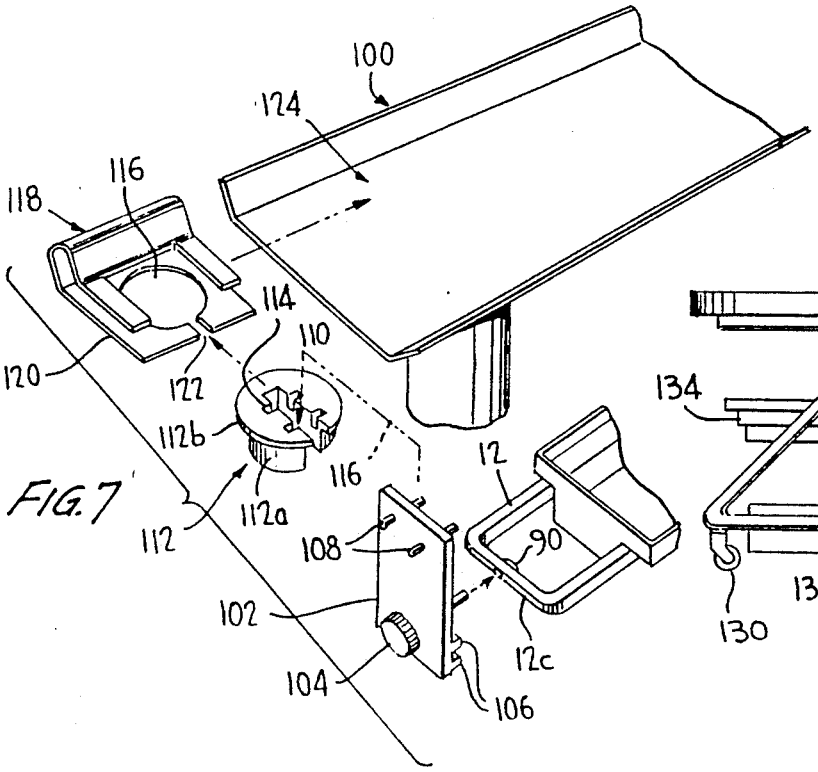
FIG. 7 is an exploded perspective view of the assembly of the tool tray support assembly of the invention as supported beneath a vehicle service lift.

The tool tray support assembly of the invention may also be arranged to hang beneath an automotive service lift 100 as shown in FIG. 7. The end support assemblies 16 and 18 are removed and replaced with a second set of identical end supports, one being indicated at 102. The end support 102 comprises a knob 104 connected to a threaded member threaded into captive nut 90 welded to lateral support member 12 by which the end support structure detailed in FIGS. 5 and 6 is attached. However, in this case there is no need to provide angular adjustment of the plane of the tool tray 22. Accordingly, the end support 102 comprises key means 106 receiving the end section **12*c* of the support member 12** to provide a stable working platform.

The upper portion of the end support 102 comprises two transversely extending pegs 108. Pegs 108 are received in recesses 110 in a circular disk member 112, while a planar portion of the vertical support member 102 fits within a transverse slot 114 extending partially across disk member 112. As indicated at 116, the end support 102 can be assembled to the disk member 112 in a foolproof and stable manner simply by inserting the end support 102 into the transverse slot 114, so that the pegs 108 fit into the recesses 110. This assembly method requires no tools. As shown, the disk member 112 comprises a cylindrical lower portion 112*a* capped by a radial flange 112*b*. The cylindrical portion 112*a* fits within a circular aperture 116 in a planar lower portion 120 of a clip 118 adapted to fit over horizontal member 124 of a standard automotive lift 100. The flange 112*b* then rests on the planar lower portion 120 of the clip 118. A gap 122 in the lower portion 120 of the clip 118 allows the vertical support member 102 to pass through the clip 118. As the circular disk 112 is supported within the circular aperture 116 in the planar portion 120 of the clip 118, the angular orientation of the tool tray support assembly of the invention may vary with respect to the horizontal member 124 of the lift 100.

In use the clip 118 will typically remain permanently on the horizontal member 124 of the automotive lift 100. The design of the clip members 118 will vary with respect to the design of the horizontal member 124 of the lift 100. The circular disk 112 may also be permanently assembled to the clip 118.

Figure 8:
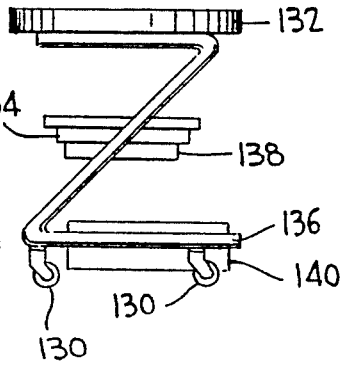
FIG. 8 is a side elevation view of a roll-around stool adapted to receive two of the tool trays employed with the tool tray support assembly of the invention.

FIG. 8 shows a rolling stool comprising casters 130, a seat 132, and one or more support members 134 and 136 for supporting tool trays according to the present invention, as indicated at 138 and 140. Kits of hardware for conveniently adapting various preexisting stools to thus receive tool trays according to the invention may be sold separately. In this way the tool trays of the invention are provided with additional flexibility, adding to their utility to mechanics and other service personnel.

A mechanic will typically store the tools and parts needed to complete a particular job in one or more of the tool trays according to the invention. When he is called upon to perform that particular job he will select those tool trays and will assemble them together with the appropriate support structure. In most cases this will involve the support structure shown in FIGS. 1 and 3, that is, employing end support assemblies 16 and 18 to support the tool tray support structure between opposed edges 60 of an engine compartment of a motor vehicle or the like. In other cases he may desire to support the tool tray support assembly according to the invention from a vehicle lift as shown in FIG. 7, or he may use one of the tool trays in conjunction with a stool as shown in FIG. 8. Assuming the first case, he adjusts the tool tray to its desired lateral extent using locking levers 72, and adjusts the relative angular orientation of the plane of the work surface 22 with respect to the lateral edges of the automobile 60 using the angular adjustment feature provided by the end support assemblies 16 and 18, as detailed in connection with FIGS. 5 and 6. He then selects the tool tray(s) containing the appropriate tools, parts, and supplies, and disposes them between the opposed parallel rails of the support member 12 and 14, and may employ the work surface 22, lamps 54 and the like as desired.

When the job is completed the mechanic may readily remove the tool trays 42 and store them in conventionally sized drawers of a tool box, and may then remove the end support assemblies 16 and 18 simply by loosening knobs 88. As noted, the end support assemblies remain assembled, so that no loose components are lost. Finally, he may then loosen locking levers 72, slide the support members 12 and 14 into the center section 10 until stop screws 68 abut stops 70, and store the entire assembly away, again in a standard tool box. In this way, the entire tool tray support assembly and the tool trays can be conveniently stored under lock and key.

It will be apparent to those of skill in the art that while a preferred embodiment of the invention has been disclosed in detail, numerous other modifications and improvements can be made thereon.

For example, numerous different sorts of accessory blocks as indicated generally at 34 and 37 may be provided to fit on the sections 24 and 26 of the extrusion on either side of the center section. Additional illumination devices may be added; a rack for holding a service manual open might conveniently be added. The tool trays may include or be fitted with tool organizers such as plastic receptacles sized to receive the members of standard tool sets, such as socket sets or screwdriver sets; alternatively, the members of a socket set may be retained on plastic studs or metal clips fitting the standard square recesses by which the sockets are affixed to a ratchet wrench for use. Other modifications similarly will occur to those of skill in the art. Therefore the above description of the invention, while disclosing the best mode of practice thereof known to the inventors at the time of filing of this application, should not be taken as a limitation on the scope of the invention but only as exemplary thereof; the scope of the invention is to be measured only by the following claims.

What is claimed is:

1. A tool tray support assembly for fitting between opposed edge surfaces of an engine compartment of a motor vehicle, comprising:

first and second substantially identical extendable lateral support members each of said members comprising spaced parallel rails and having an end section connecting distal ends of said parallel rails;

a center member, having a substantially planer work surface, and comprising a set of spaced bearing members for receiving proximal ends of said spaced parallel rails, such that said at least one lateral support member is slidably received within said set of spaced bearing members;

first and second end supports, for mating with end sections of said extensible lateral support members at opposite lateral ends of said tool tray support assembly;

at least one tool tray adapted to be supported on said spaced parallel rails of said at least one lateral support member, between said end section thereof and said center member; wherein said center member comprises two substantially identical sets of said spaced bearing members for receiving said extensible lateral support members from opposite lateral ends thereof, and all members of said substantially identical sets of spaced bearing members are disposed in a single plane parallel to said work surface; and wherein said sets of spaced bearing members receiving parallel rails of said lateral support members are disposed along opposed edges of said work surface; and said identical sets of spaced bearing members comprise two sections of a continuous extrusion, defining two longitudinal channels, each for slidably receiving one of said parallel rails of one of said lateral support members.

2. The assembly of claim 1, further comprising means for locking the lateral support member at a desired position with respect to said center member.

3. The assembly of claim 2, wherein said means for locking comprises a locking arm pivoted about an axis fixed with respect to said center member, said locking arm comprising a cammed friction surface and being adapted to be pivoted to an engaged position to clamp a rail of said support member against the corresponding bearing member.

4. The assembly of claim 3, further comprising an anti-friction member disposed between said friction surface of said locking arm and said rail of said support member, to allow free sliding movement of said rail with respect to said center member when said locking arm is in a disengaged position.

5. The assembly of claim 1, wherein at least said end support attachable to said end section of said lateral support member comprises a foot member for engaging one of said opposed edge surfaces, a mounting means for engaging said lateral support member, and a vertical spacing member extending between said foot member and said mounting means.

6. The assembly of claim 5, wherein said mounting means comprises lockable pivot means whereby said lateral support member is permitted to be pivoted with respect to said vertical spacing member through a range of angles about a generally horizontal axis, and wherein said lateral support member may be secured to said vertical spacing member at any desired angle of said range of angles, whereby said tool tray support assembly may be secured in a desired horizontal position while said assembly is fitted between opposed edge surfaces that may be disposed at an angle to the horizontal.

7. The assembly of claim 6, wherein said lockable pivot means comprises a locking member having a first radially keyed surface, means for selectively urging said first radially keyed surface axially into non-rotating engagement with a corresponding second radially keyed surface fixed with respect to said vertical spacing member, and means for preventing rotation of said lateral support member with respect to said locking member about said generally horizontal axis.

8. The assembly of claim 7, wherein said means for selectively urging comprises a threaded member extending through an aperture in said locking member and threadedly engaging the end section of said lateral support member, for urging said first radially keyed surface on said locking member into engagement with said second radially keyed surface.

9. The assembly of claim 8, wherein a grippable knob is fixed to an end of said threaded member, and an opposite end of said threaded member is threaded into said lateral support member.

10. The assembly of claim 8, further comprising means for retaining said locking member on said threaded member.

11. The assembly of claim 10, wherein said means for retaining is spring clip means received in a corresponding groove in said threaded member.

12. The assembly of claim 7, further comprising resilient means for positively axially disengaging said radially keyed surfaces from one another when said means for selectively urging is operated to disengage said radially keyed surfaces from one another.

13. The assembly of claim 12, wherein said resilient means comprises a spring washer.

14. The assembly of claim 7, wherein said vertical spacing member is molded integrally to include said foot member and said second radially keyed surface.

15. The assembly of claim 7, wherein said locking member is molded to include said first radially keyed surface.

16. The assembly of claim 7, wherein said end section of said lateral support member comprises keying means and said locking member comprises a recess for receiving said keying means, for preventing rotation of said lateral support member with respect to said locking member about said generally horizontal axis.

17. The assembly of claim 16, wherein said lateral support member comprises a member of substantially continuous cross-section formed into a U-shape to define said spaced parallel rails and said end section connecting the distal ends thereof.

18. The assembly of claim 17, wherein said recess in said locking member receives the end section of said lateral support means, whereby said end section of said lateral support means serves as said keying means.

19. The assembly of claim 1, wherein said end supports are substantially identical, said extensible lateral support members are substantially identical, and said center member comprises two substantially identical sections of a continuous extrusion, each section defining two continuous channels for receiving the spaced parallel rails of said two substantially identical lateral support members, and a planar shelf member, said sections of extrusion being fixed generally along opposite laterally extending edges of said planar shelf member, so that said channels for slidably receiving the parallel rails of said lateral support member lie in a plane parallel to the planar shelf member, and the parallel rails are received in interdigitated relationship.

20. The assembly of claim 19, wherein a threaded hole for mounting said end supports is formed in the end section of each of said lateral support members, said threaded holes being off-center with respect to the parallel rails of said lateral support members, whereby said threaded holes lie substantially on the centerline of said planar shelf member when said parallel rails are assembled into the channels of said sections of said extrusion.

21. The assembly of claim 19, wherein said extrusion includes a generally C-shaped flange member on an upper surface thereof.

22. The assembly of claim 21, in combination with an accessory member comprising a hook member mating with said C-shaped flange member.

23. The combination of claim 22, wherein said accessory member comprises a magnet for supporting ferrous tools.

24. The combination of claim 22, wherein said accessory member comprises a small box member defining a recess for containing small parts.

25. The combination of claim 24, wherein said recess is formed to have a curved interior corner joining a floor and an interior wall of said recess, to allow convenient removal of said small parts therefrom.

26. The assembly of claim 19, in combination with a lamp supported beneath said center member.

27. The combination of claim 26, wherein said sections of said extrusion include lower horizontal tab members, and said combination further includes a translucent window for protecting said lamp supported by said tab members.

28. The assembly of claim 19, in further combination with means for supporting said tool tray support assembly from a vehicle service lift.

29. The combination of claim 28, wherein said means for supporting comprise third and fourth end supports for selective replacement of said first and second end supports, said third and fourth end supports being selectively affixed to said lateral support members.

30. The combination of claim 29, wherein said third and fourth end supports comprise vertical support members, mounting means fixable to said vertical support members for engaging said lateral support members, and engagement means fixable to said vertical support members for engaging a vehicle service lift.

31. The combination of claim 30, wherein the relative angular position of one of said mounting means and said engagement means may be adjusted with respect to said vertical support member, to permit variation of the angular orientation of said tool tray assembly with respect to a vehicle service lift.

32. The combination of claim 31, wherein said engagement means comprises a horizontal planar member adapted to be fixed to said vehicle service lift and having a circular aperture therein, and a disc member adapted to be fixed to said vertical support member and comprising a cylindrical central portion adapted to be received in said circular aperture and a flange portion extending radially outwardly from said cylindrical central portion, for supporting said disc member on said horizontal planar member.

33. The assembly of claim 19, in further combination with a work stool, said stool comprising spaced parallel rails for supporting said tool trays.

34. A tool tray support assembly for fitting between opposed edge surfaces of an engine compartment of a motor vehicle comprising:

at least one extensible lateral support member, comprising spaced parallel rails and an end section connecting distal ends of said parallel rails;

a center member comprising a set of spaced bearing members for receiving proximal ends of said spaced parallel rails, such that said at least one lateral support member is slidably received within said set of spaced bearing members;

first and second end supports, for mating with the opposed edge surfaces of said engine compartment, one of said end supports being attachable to said end section of said lateral support member, comprises a foot member for engaging one of said opposed edge surfaces, a mounting means for engaging said lateral support member, and a vertical spacing member extending between said foot member and said mounting means; and the other of said end support members being attachable to an opposite lateral end of said tool tray support assembly;

said mounting means comprising lockable pivot means whereby said lateral support member is permitted to be pivoted with respect to said vertical spacing member through a range of angles about a generally horizontal axis, and wherein said lateral support member may be secured to said vertical spacing member at any desired angle of said range of angles, whereby said tool tray support assembly may be secured in a desired horizontal position while said assembly is fitted between opposed edge surfaces that may be disposed at an angle to the horizontal;

said lockable pivot means comprising a locking member having a first radially keyed surface, means for selectively urging said first radially keyed surface axially into non-rotating engagement with a corresponding second radially keyed surface fixed with respect to said vertical spacing member, and means for preventing rotation of said lateral support member with respect to said locking member about said generally horizontal axis; and at least one tool tray adapted to be supported on said spaced parallel rails of said at least one lateral support member, between said end section thereof and said center member.

35. The assembly of claim 34, wherein said cooperating means for limiting comprises a peg on one of said locking member and said vertical spacing member, and an arcuate recess of radially limited extent formed in the corresponding surface of the other of said locking member and vertical spacing member, said peg fitting into said arcuate recess.

36. A tool tray support assembly for fitting between opposed edge surfaces of an engine compartment of a motor vehicle comprising:

at least one extensible lateral support member, comprising spaced parallel rails and an end section connecting distal ends of said parallel rails;

a center member comprising a set of spaced bearing members for receiving proximal ends of said spaced parallel rails, such that said at least one lateral support member is slidably received within said set of spaced bearing members;

first and second end supports, for mating with the opposed edge surfaces of said engine compartment, one of said end supports being attachable to said end section of said lateral support member, and the other of said end support members being attachable to an opposite lateral end of said tool tray support assembly;

at least one tool tray adapted to be supported on said spaced parallel rails of said at least one lateral support member, between said end section thereof and said center member; and;

wherein each of said one or more tool trays comprises laterally spaced generally T-shaped end members including lower central wall portions and opposed upper projections, a central floor section joining the lower extremities of said T-shaped end members, and spaced opposed lateral wall sections, whereby each tray includes a relatively deep center section for fitting between said parallel rails of said at least one lateral support member, and whereby said tool trays may be supported upon said parallel rails by said opposed upper projections resting thereon.

37. The assembly of claim 36, wherein the overall dimensions of said tool trays are such that said trays fit efficiently within the drawers of standard tool chests.

38. A tool tray assembly for being supported at opposite lateral ends on opposed edges of a vehicle engine compartment, comprising:

two lateral support members, each comprising two spaced parallel elongated rails joined at their distal ends by end sections;

a central member comprising a work shelf and spaced bearing channels for slidably receiving proximal ends of said parallel rails of said support members;

two end support means each comprising a foot member for engaging one of said edges and a vertical spacing section lockably pivotally joined to the corresponding one of said lateral support members at the end sections thereof;

one or more tool trays each comprising a central relatively deep section for fitting between said rails of said lateral support members and overhanging portions on either side of said center section for supporting said trays on said rails; and wherein said lateral support members are substantially identical, said end support means are substantially identical, and said central member comprises two pairs of said spaced bearing channels for slidably receiving said parallel rails of said lateral support members.

39. The assembly of claim 38, wherein said pairs of spaced bearing channels of said central member are formed of substantially identical sections of a continuous extrusion.

40. The assembly of claim 39, wherein said pairs of spaced bearing channels are arranged such that said rails when received thereby are laterally spaced from one another and lie in a plane parallel to said work shelf.

41. The assembly of claim 38, wherein the respective rails of each of said lateral support members are equally spaced from one another, and are received in said spaced bearing channels in overlapping, interdigitated relation.

42. The assembly of claim 38, wherein said end support means are molded so that each comprises substantially identical molded foot members and vertical spacing sections.

43. The assembly of claim 38, further comprising first and second locking means for locking said support members in desired positions with respect to said central member.

44. The assembly of claim 38, wherein each of said lateral support members comprises a member of continuous cross section formed into a U-shape defining said spaced parallel rails and said end section.

45. The assembly of claim 44, wherein said end support means each further comprise a key member having a slot therein for receiving said end section of the corresponding U-shaped lateral support member, said key member further comprising radial keys for being urged axially into locking engagement with mating radial keys fixed to said vertical spacing section of said end support means.

46. The assembly of claim 45, wherein said end support means each further comprise threaded members, one end thereof being threaded into said end sections of said lateral support members and the other end being fixed to a grippable knob, whereby tightening said threaded member into said lateral support member by said knob retains said end section of said lateral support member within said slot and urges said radial keys on said key member and said mating radial keys fixed to said vertical spacing section axially into locking engagement with one another, thus fixing said lateral support members with respect to said foot members.

47. The assembly of claim 46, further comprising spring washer means disposed between said mating radial keys for positively disengaging said keys from one another, and retainer means for retaining said key members on the corresponding threaded members.

48. A tool tray assembly for being supported at opposite lateral ends on opposed edges of a vehicle engine compartment, comprising:

two lateral support members, each comprising two spaced parallel elongated rails joined at their distal ends by end sections;

a central member comprising a work shelf and spaced bearing channels for slidably receiving proximal ends of said parallel rails of said support members;

two end support means each comprising a foot member for engaging one of said edges and a vertical spacing section lockably pivotally joined to the corresponding one of said lateral support members at the end sections thereof;

one or more tool trays each comprising a central relatively deep section for fitting between said rails of said lateral support members and overhanging portions on either side of said center section for supporting said trays on said rails; and further comprising two additional end support members for supporting the assembly of said lateral support members and said central member beneath an automotive service lift.

* * * * *